United States Patent [19]

Svensson

[11] 4,339,942

[45] Jul. 20, 1982

[54] HYDRAULICALLY OPERATED CRIMPING TOOL

[76] Inventor: Uno Svensson, Porlabacken 5, 124 45 Bandhagen, Sweden

[21] Appl. No.: 185,688

[22] Filed: Sep. 10, 1980

[30] Foreign Application Priority Data

Sep. 10, 1979 [SE] Sweden ..... 7907468

[51] Int. Cl.[3] ..... B21D 7/06

[52] U.S. Cl. ..... 72/453.16; 60/479; 72/410; 72/416; 72/453.02; 81/301

[58] Field of Search ..... 72/453.16, 453.15, 453.19, 72/452.02, 416, 409, 410; 81/301; 60/479, 477

[56] References Cited

U.S. PATENT DOCUMENTS

| | | | |
|---|---|---|---|
| 3,740,952 | 6/1973 | Fujii | 60/477 |
| 4,136,549 | 1/1979 | Lytle | 72/453.16 |
| 4,151,720 | 5/1979 | Vanderstappen | 81/301 |
| 4,226,110 | 10/1980 | Suganuma | 72/453.16 |

*Primary Examiner*—Gene Crosby

*Attorney, Agent, or Firm*—Burns, Doane, Swecker & Mathis

[57] ABSTRACT

A hydraulically operated crimping tool (1) for attaching an electrical connector to an electrical conductor, consisting of a hydraulic oil reservoir (27), which is connected to a pump unit (26) which when operated will pump oil under pressure into an enclosed space (25), into which is introduced a pin (1*k*), said pin being so arranged as to move out of the space as pressure is applied. Upon the initial activation of the pump unit (26) oil is pumped into a small space (24) of small area and volume, where a small quantity of oil will produce large movement of the pin (1*k*). This movement will then cause a second enclosed space (25) of greater area and of greater volume to be filled with oil. As resistance begins to occur to the movement of the pin (1*k*) the pump unit (26) will pump the quantity of oil to the second enclosed space (25) of greater area.

7 Claims, 12 Drawing Figures

HYDRAULICALLY OPERATED CRIMPING TOOL

TECHNICAL FIELD

The present invention relates to a hydraulically operated crimping tool and in particular to a type of hydraulically operated crimping tool designed for attaching an electrical connector to an electrical conductor. The crimping tool may be used with particular advantage when it is to perform a compressing operation, for instance the clamping or crimping of a cable terminal to an electrical cable or conductor.

DESCRIPTION OF THE PRIOR ART

We are already familiar with a device for generating hydraulic pressure, particularly when it is connected to a hydraulically operated tool, used to perform a compressing operation. This device contains a reciprocating pump which is moved forwards and backwards by means of an operating device, thereby generating the desired hydraulic pressure. By arranging the pump as a cylinder block, this may be permanently installed against the wall of a container, of which the part which faces away from the cylinder block combines with an end wall to form a reservoir for the hydraulic fluid between the cylinder block and the end wall. In this case, the cylinder block is designed with a first valve, intended to open an outlet for the hydraulic fluid from the delivery side of the pump after completion of the work operation, a second valve, which is also connected to the delivery side of the pump and which is so arranged that it is closed during the work operation, but that it will open as the pressure exceeds a predetermined value and will remain open until the pressure exhibits a second predetermined value, a third valve which enables fluid to be forced to the tool from a high-pressure pump, a fourth valve which enables fluid to be forced to the tool from a low-pressure pump, a fifth valve designed to permit fluid to flow from the reservoir to the cylinder of the low-pressure pump during the return stroke of the piston, and a sixth valve designed to permit fluid to flow from the reservoir to the cylinder of the high-pressure pump during the return stroke of the piston.

It has previously been common practice in a device of this kind to make use of a fourth and a fifth valve and to position these diametrically in relation to the cylinder block and also to position the first valve and the sixth valve diametrically to the cylinder block. One side of the fourth valve activates the low-pressure pump and the other side influences the operating pressure for the tool. The fourth valve is so arranged that it will cut off the effect of the low-pressure pump on the operating pressure at a third predetermined operating pressure, so that this is built up only by the high-pressure pump.

The device described above has been described previously in Swedish Patent Application No. 78 01176-4.

DESCRIPTION OF THE PRESENT INVENTION

TECHNICAL PROBLEM

In the case of hydraulically operated crimping tools, one of the primary objectives is to produce very great movement of the pin in the direction of the electrical connector for only slight action of the hydraulic pump, with the actual crimping operation being produced by the hydraulic pressure generated by the pump unit only when the pin comes into contact with the connector.

Although the pin must be subjected to considerable force via the hydraulic pressure, there is nevertheless a primary objective that the force required to work the pump unit shall remain low or shall at least lie within limits which permit the hydraulically operated crimping tool to be handled in a practical manner.

By providing a large surface area, a certain pressure at the pin will require the use of a considerable quantity of oil and the generation of a certain level of pressure, which in turn will involve prolonged operation of the pump unit.

A smaller surface area will, for an identical level of pressure at the pin, require the use of a smaller quantity of oil, but will demand in return increased pressure from the pump unit.

Hydraulically operated crimping tools of the type indicated above thus pose a technical problem of designing the pump unit in such a way that the pin will be moved for a great distance with the use of a small quantity of oil to the point at which the pin comes into contact with the electrical connector, and that only then will the quantity of oil pumped by the pump unit pass into an enclosed space with a larger surface area and under high pressure.

SOLUTION

The present invention relates to a hydraulically operated crimping tool by means of which an electrical connector may be attached to an electrical conductor. The crimping tool consists of a hydraulic oil reservoir which is connected to a pump unit which when operated will pump oil under pressure into an enclosed space, into which is introduced a pin, said pin being so arranged as to move out of the space as pressure is applied. The solution in accordance with the present invention consists of initially activating the pump unit so that oil is pumped into a small space of small area and of small volume which makes up the enclosed space in which a small quantity of oil will produce large movement of the pin, said movement likewise filling the second enclosed space of greater area and of greater volume. As initial resistance is felt to the movement of the pin, i.e. as the pin comes into contact with the electrical connector, the pump unit will pump a quantity of oil into the enclosed space of greater area, thereby assuring the increased pressure between the pin and the electrical connector.

This may be achieved by the pump unit forcing a quantity of oil via a check valve and into the smaller space, when movement of the pin will produce reduced pressure in the other enclosed space and will thus suck in a quantity of oil corresponding to the movement of the piston from the hydraulic oil reservoir.

ADVANTAGES

The principal advantages associated with a hydraulically operated crimping tool in accordance with the present invention are that the pump unit is capable of being operated by simple means, irrespective of whether the movement of the pin in the direction of the electrical connector occurs with or without resistance.

The invention thus illustrates a possible means by which, depending on the resistance to the movement of the pin, the quantity of oil pumped by the oil pump may be supplied either to a small area in order to produce large movement or to a large area in order to produce small movement in relation to a single stroke of the pump unit.

What may be regarded as the principal characteristic features of a hydraulically operated crimping tool in accordance with the present invention are indicated in the first Paragraph of the following Patent Claim.

DESCRIPTION OF THE DRAWINGS

A provisional preferred embodiment indicating the significant characteristic features of the present invention is described in greater detail with reference to the attached drawing, in which.

DESCRIPTION OF THE PREFERRED EMBODIMENT

Figure 1:
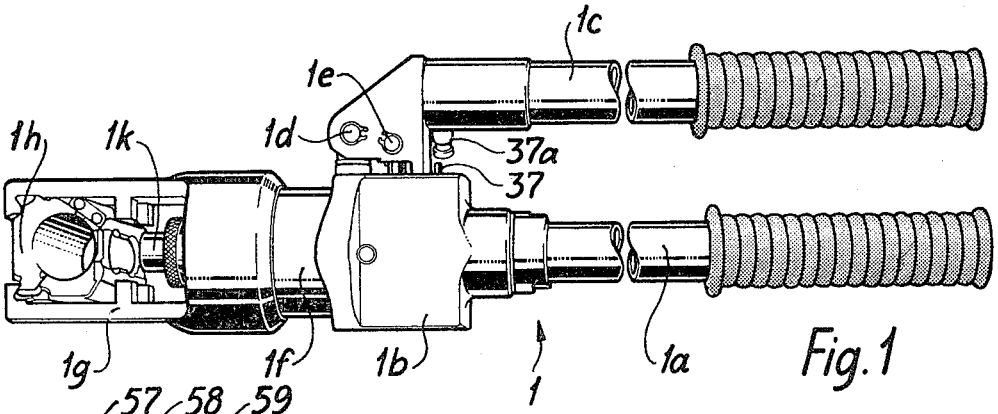
FIG. 1 shows a perspective view of a hydraulically operated crimping tool in accordance with the present invention.
Figure 12:
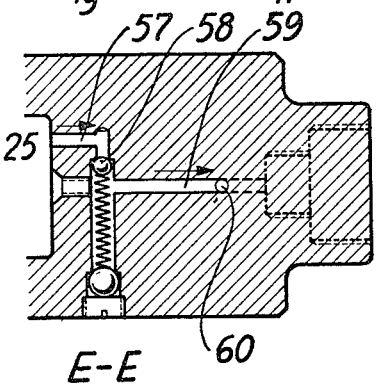
FIG. 12 shows the section E—E in FIG. 3 with the check valves in position.

FIG. 1 thus illustrates a hydraulically operated crimping tool 1 in accordance with the present invention in which one shank 1*a* is permanently attached to a main component 1*b*. A second shank 1*c* is attached by means of a pivoting shaft 1*d* in such a way that it can turn in relation to the main component 1*b* and by means of a shaft 1*e* so arranged that it will activate a pump unit contained in the main component. A hydraulic oil reservoir which is not shown in FIG. 1 is contained inside the shank 1*a*.

The main component 1*b* has a collar 1*f* to which a device 1*g* is attached. This device consists of a matrix 1*h*, into which matrix are introduced on the one hand an electrical connector and on the other hand an electrical conductor in the usual way. An important feature of the present invention is the pin 1*k*, which operates in conjunction with a hydraulic cylinder, said pin 1*k* being designed in such a way that it may be forced into the electrical connector so as to produce an electrical and mechanical contact between the electrical connector and the electrical conductor.

The pin 1*k* is connected to a hydraulic piston 21 which is so arranged that it will move inside a cylinder 22. The piston 21 has a flange 21*a* and a seal 21*b*. The flange 21*a* and the piston 21 are forced into the position illustrated in FIG. 2 by means of a spring 23. The piston 21 is designed to have a central recess (space) 24, which presents a smaller area and volume than the other enclosed area 25, which is of greater area and of greater volume. A seal 29*b* bears against the tube which forms the duct 29.

Figure 2:
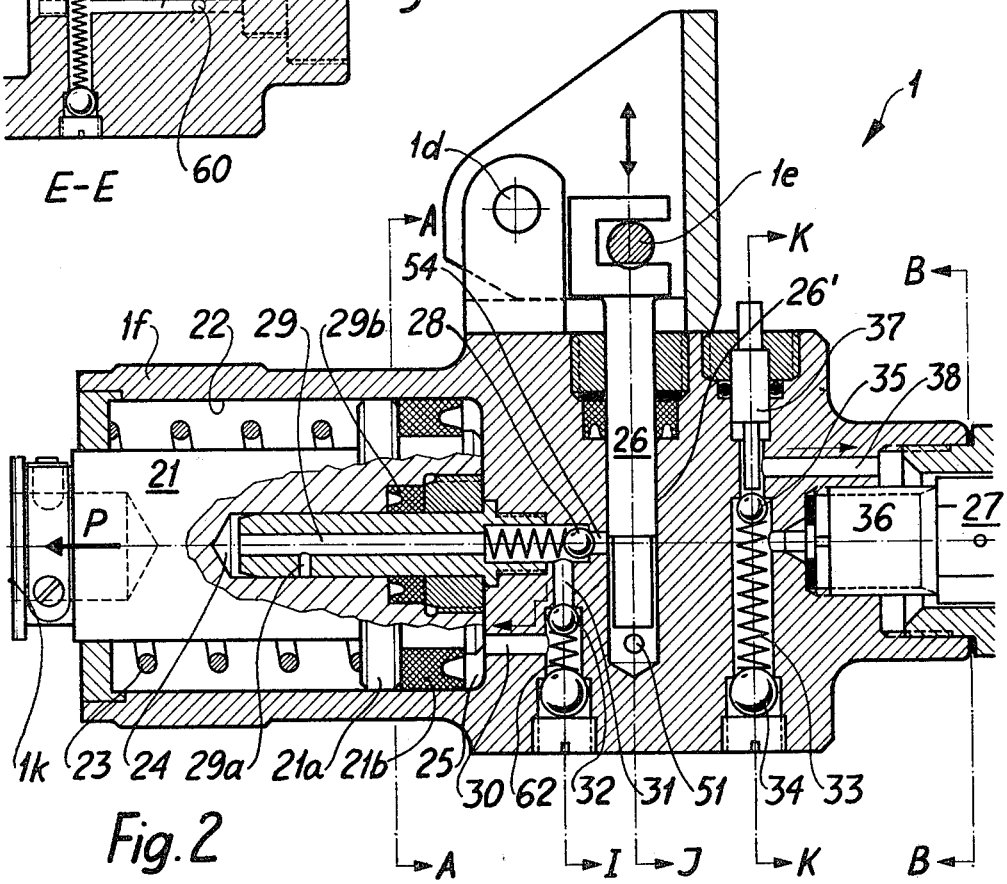
FIG. 2 shows the central components of the crimping tool in accordance with FIG. 1.
Figure 3:
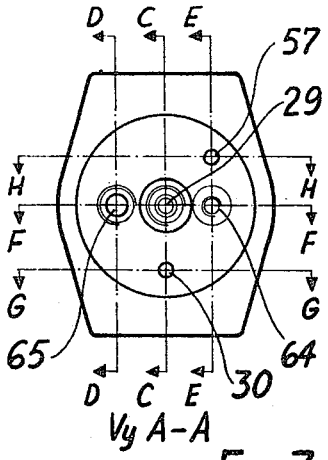
FIG. 3 shows the section A—A in FIG. 2.
Figure 4:
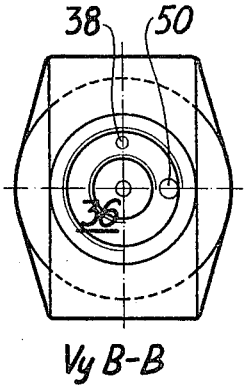
FIG. 4 shows the section B—B in FIG. 2.
Figure 5:
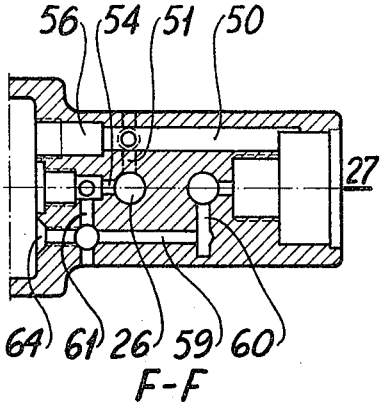
FIG. 5 shows the section F—F in FIG. 3.
Figure 6:
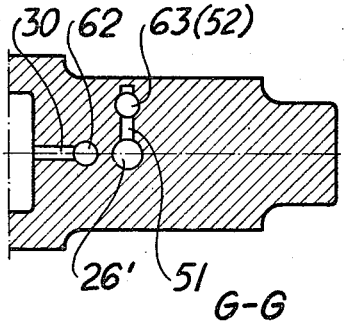
FIG. 6 shows the section G—G in FIG. 3.
Figure 7:
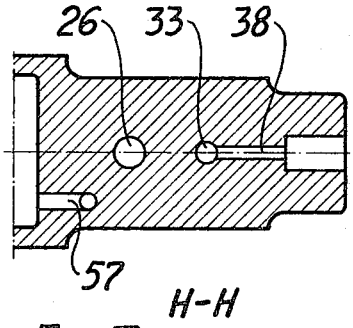
FIG. 7 shows the section H—H in FIG. 3.
Figure 8:
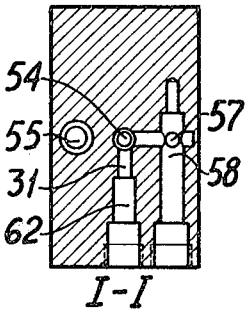
FIG. 8 shows the section I—I in FIG. 2.

The reference number 26 indicates a pump unit (a piston) to which the movement of the arm 1*d* gives an up-and-down movement as seen in FIG. 2 via the shaft 1*e* and the pivoting shaft 1*d*. As the piston-rod 26 moves upwards in the cylinder 26′ the space is filled with oil from the reservoir 27 and as the piston-rod 26 moves in the opposite direction the oil will flow under pressure through a check valve 28 and through a duct 29 to the space 24. It is thus quite clear that an extremely small quantity of oil will produce a considerable movement of the piston 21 in the direction of the arrow "P", but on condition that the resistance to said movement is low.

It should be taken into consideration, however, that any movement of the piston 21 will, because of the quantity of oil which flows through the duct 29 to the smaller space 24, also bring about a reduction in pressure in the larger space 25, which is filled with oil via a duct 50, inter alia.

As soon as the pin 1*k* comes into contact with the electrical connector the piston 21 will no longer be able to advance, due to the hydraulic pressure in the oil which is flowing through the duct 29 to the space 24, and the hydraulic pressure and the quantity of oil must now flow through a duct 30 into the larger space 25.

The pressure which is present in the space 24 and 25 will also be present in the space 33. The space 33 interacts partly with a check valve 34 and partly with a check valve 55, as well as with a pressure relief valve 36. The pressure relief valve 36 is so arranged as to release as a predetermined level of high pressure is reached in the space 24 and 25, thus also enabling the volume of oil which is under pressure to flow back to the hydraulic oil reservoir 27.

The check valve 35 works in conjunction with a valve 37, which is a safety valve and which may thus be set to release at any desired point during the crimping process. However, particular consideration should be given to the fact that the valve 37 may be activated only with difficulty for as long as high pressure is present in the space 33. The valve may be activated by turning the shank 1*c* so that a spigot 37*a* is positioned above the valve body 37, and the valve 37 may then be opened by forcing the shank 1*c* downwards as shown in FIG. 2. It is difficult to activate the valve 37 during the actual crimping phase, due to the high pressure which is present in the space 33. After the valve 36 has been released low pressure will be present in the space 33 and the valve 37 may then be activated with ease.

The reference number 38 indicates a duct in which neutral conditions of pressure are present, said duct interacting directly with the hydraulic oil reservoir 27. (Consideration should nevertheless be given to the fact that both the reservoir 27 and the piston 38 are under a slight amount of excess pressure). The up-and-down movement of the pump unit 26 will immediately generate low pressure in the duct 29, with said low pressure causing the piston 21 to move rapidly in the cylinder 22 so that the pin 1*k* comes into contact with the electrical connector. The continued activation of the hydraulic pump 26 will now place the hydraulic oil under high pressure and this will flow through the duct 31 past the check valve 32 via the duct 30 and into the larger space 25.

It may be stated in this connection that the valve 32 must be so dimensioned that its spring is capable of forcing the ball against its seating with such force that it is able to overcome the pressure produced by the strong return spring 23 (as well as the friction and the low pressure forces) which should produce a higher pressure in the duct 29 and in the space 33 than in the space 25. So that this higher pressure shall not cause the pressure relief valve 36 to release, it is suggested that a connecting passage between the two spaces 24 and 25 should open immediately before the piston 21 reaches the end of its fully extended stroke. This has been illustrated as a diametrically positioned duct 29*a*.

The following functional description shall apply, and reference is made to the various ducts which are shown in FIGS. 2–12.

Figure 9:
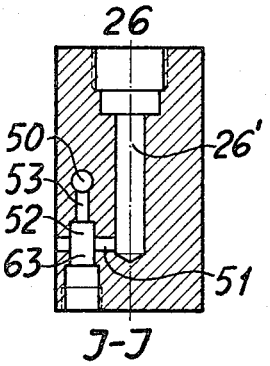
FIG. 9 shows the section J—J in FIG. 2.
Figure 10:
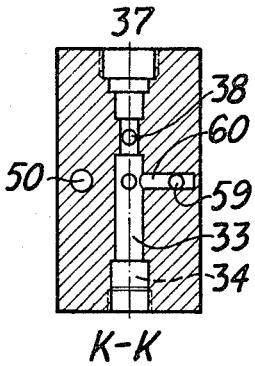
FIG. 10 shows the section K—K in FIG. 2.
Figure 11:
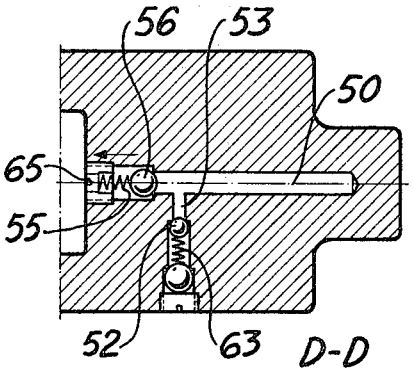
FIG. 11 shows the section D—D in FIG. 3 with the check valves in position.

The piston 26 is moved upwards in the cylinder 26' in FIG. 2 causing oil to flow through the ducts 50,53 the check valve 52 and the duct 51 to the cylinder 26" (FIG. 9).

As the piston is moved downwards oil is forced via the duct 54 to a valve 28 through the duct 29 and into the space 24. (The valve 32 is assumed to be closed due to the low pressure which is present).

When the piston 21 is now moved to the left, as shown in FIG. 2, low pressure will occur in the space 25, which is filled with oil via a duct 55, a check valve 56 positioned inside the duct, and via the duct 50.

The space 25 and the space 33 are joined by a return passage (with the piston moved to the right) with the reference 57, a valve 58, and the ducts 59 and 60. The valves 35 and 36 are closed.

A return passage runs from the space 24 and the duct 29 via the duct 61 to the ducts 59 and 60 and into the space 33.

The reference number 64 is used to indicate a screw which acts as a plug, and 65 indicates a holder through which there runs a hole for a spring 55 which acts upon a ball 56 which serves as a check valve.

This invention is not of course restricted to the embodiment shown above as an example, but may be modified within the context of the following Patent Claim.

I claim:

1. Hydraulically operated crimping tool (1) for attaching an electrical connector to an electrical conductor, consisting of a hydraulic oil reservoir (27), which is connected to a pump unit (26) which when operated will pump oil under pressure into an enclosed space (25), into which is introduced a pin (1*k*), said pin being so arranged as to move out of the space as pressure is applied, characterized in that upon the initial activation of the pump unit (26) oil is pumped into a small space (24) of small area and volume, where a small quantity of oil will produce large movement of the pin (1*k*), said movement likewise causing the other enclosed space (25) of greater area and of greater volume to be filled with oil, but as resistance begins to occur to the movement of the pin (1*k*) the pump unit (26) will pump the quantity of oil to the enclosed space (25) of greater area.

2. Hydraulically operated crimping tool in accordance with claim 1, characterized in that the pump unit forces a quantity of oil via a check valve (28) into the smaller space (24) and movement of the pin (1*k*) will produce reduced pressure in the other enclosed space (25) which will suck a quantity of oil from the hydraulic oil reservoir (27).

3. Hydraulically operated crimping tool in accordance with claim 1, characterized in that as resistance begins to occur a quantity of oil is pumped via a check valve (32) into the other enclosed space (25).

4. Hydraulically operated crimping tool in accordance with claim 1, characterized in that a pressure relief valve (36) is connected to the outlet from the pump unit and is set to release at a predetermined pressure when oil will be allowed to flow back to the hydraulic oil reservoir (27).

5. Hydraulically operated crimping tool in accordance with claim 1, characterized in that a release device (37) is so arranged as to activate a check valve (35) which will compel oil to flow back to the reservoir (27).

6. Hydraulically operated crimping tool in accordance with claim 1, characterized in that the oil in the hydraulic oil reservoir (27) is under pressure.

7. Hydraulically operated crimping tool in accordance with claim 1, characterized in that immediately before the piston (21) reaches the end of its stroke a connecting passage (29*a*) is opened between the two spaces (24 and 25).

* * * * *